US007838785B2

(12) United States Patent
Sung

(10) Patent No.: US 7,838,785 B2
(45) Date of Patent: Nov. 23, 2010

(54) KEYPAD ASSEMBLY

(75) Inventor: Joohun Sung, Seongnami-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 28 days.

(21) Appl. No.: 12/070,800

(22) Filed: Feb. 21, 2008

(65) Prior Publication Data

US 2008/0257699 A1 Oct. 23, 2008

(30) Foreign Application Priority Data

Apr. 19, 2007 (KR) ..... 10-2007-0038193

(51) Int. Cl.
*H01H 9/00* (2006.01)

(52) U.S. Cl. ..... 200/314; 200/313

(58) Field of Classification Search ..... 200/314
See application file for complete search history.

(56) References Cited

U.S. PATENT DOCUMENTS 7,186,935 B2 * 3/2007 Lee et al. ..... 200/310
7,423,229 B2 * 9/2008 Chen ..... 200/314
7,442,889 B2 * 10/2008 Lee et al. ..... 200/314
2007/0039809 A1 * 2/2007 Aihara et al. ..... 200/310
2008/0296135 A1 * 12/2008 Chikahisa et al. ..... 200/314

* cited by examiner

*Primary Examiner*—Michael A Friedhofer
*Assistant Examiner*—Lheiren Mae A Caroc

(57) ABSTRACT

A keypad assembly for radiating light to a key button using a light conductive plate is provided. The keypad assembly having a key pad with key buttons includes: a light conductive plate for advancing light emitted through a side surface thereof into the inside thereof and for radiating light to the key buttons by a reflection pattern; a light emitting element for emitting light through the said side surface of the light conductive plate into the inside of the light conductive plate; and a reflecting plate formed in a side surface of the light conductive plate to which light emitted from the light emitting element is directed to reflect light into the inside of the light conductive plate. Therefore, by reflecting light that would otherwise be discharged outside the keypad assembly to the inside of the light conductive plate using the reflecting plate, the light can be used. Accordingly, a light utilization efficiency can be improved, the quantity of light emitting elements can be reduced, and power consumption can be reduced.

20 Claims, 6 Drawing Sheets

KEYPAD ASSEMBLY

CROSS-REFERENCE TO RELATED APPLICATION(S) AND CLAIM OF PRIORITY

This application claims priority to an application entitled "KEYPAD ASSEMBLY" filed in the Korean Intellectual Property Office on Apr. 19, 2007 and assigned Serial No. 2007-0038193, the contents of which are incorporated herein by reference.

TECHNICAL FIELD OF THE INVENTION

The present invention relates to a keypad assembly, and more particularly, to a keypad assembly for radiating light to a key button using a light conductive plate.

BACKGROUND OF THE INVENTION

A keypad assembly is provided in an electronic device such as a mobile terminal to generate an electrical signal required for operation. The keypad assembly includes a lighting device to enable easy operation of an electronic device in a dark lighting environment, such as at night or in a dark location.

In general, an independent lighting-type keypad assembly that illuminates a key button by providing a light emitting element in each key button is well known. However, in an independent lighting-type keypad assembly, because the same number of light emitting elements as key buttons is required, manufacturing cost and power consumption are high.

In order to solve such a problem, a lighting type keypad assembly using a light conductive plate is used. This type of keypad assembly illuminates all key buttons with a small quantity of light emitting elements by widening a light emitting range using the light conductive plate. Because this type of keypad assembly is effective for cost reduction and power consumption reduction, the use of this type of keypad assembly has gradually increased. An example of the lighting type keypad assembly using the light conductive plate is described hereinafter.

FIG. 1 is a cross-sectional view illustrating a structure of a conventional keypad assembly, and FIG. 2 is a diagram illustrating operation of the conventional keypad assembly of FIG. 1.

Referring to FIGS. 1 and 2, a conventional keypad assembly 310 includes a keypad 320, electrically conductive dome 336, printed circuit board (PCB) 331, light emitting diode 341, and light conductive plate 343. The keypad 320 includes a plurality of key buttons 322. The keypad assembly 310 has a structure in which the key buttons 322 are arranged in an upper part of the light conductive plate 343 and in which two light emitting diodes (341, 342) are provided at one edge of the light conductive plate 343.

Light generated in each of the light emitting diodes (341, 342) is applied to a side surface of the light conductive plate 343 and diffused to the inside of the light conductive plate 343. As the light advances through the inside of the light conductive plate 343, reflective patterns 345 formed in a lower part of the light conductive plate 343 below the key buttons 322 reflect the light to key button light emitting areas 347 and transmit the light towards the key buttons 322. Accordingly, the key buttons 322 receive light to become illuminated.

However, in the conventional keypad assembly, much light loss is generated in the outermost sides of the light conductive plate. Due to the rectilinearity of light, much of the light applied through a side surface of the light conductive plate is discharged to the outside through other side surfaces of the light conductive plate, as indicated by arrows in FIGS. 1 and 2. Particularly, much light is lost through the side surface opposite to the side surface to which light is applied. Further, because the conventional keypad assembly has a light emitting angle of about 120 degrees, as displayed with a broken line in FIG. 2, light is not transmitted to two corners A and B of the side in which the light emitting diode is provided.

Accordingly, brightness of the key button deviates according to the key button position. In order to compensate the deviation of brightness and to secure light intensity, it is necessary to provide light emitting diodes at two or more positions. For this, as a plurality of light emitting elements is used, current consumption increases and cost increases.

According to an experimental result of the present applicant, it can be seen that 50% or more of the input light is not used to illuminate a key button and is lost. Current of about 20 mA is generally consumed per light emitting diode for a keypad backlight for illuminating the key buttons. In the above-described keypad assembly, it is confirmed that current of 40 mA or more is consumed for illumination of the keypad assembly.

SUMMARY OF THE INVENTION

To address the above-discussed deficiencies of the prior art, the present invention provides a keypad assembly that can reduce the quantity of light sources by minimizing light loss and improving light utilization efficiency.

The present invention further provides a keypad assembly that can provide uniform brightness of a key button.

In one aspect of the present invention, a keypad assembly having a keypad with key buttons includes: a light conductive plate for advancing light emitted through a side surface thereof into the inside thereof and for radiating light to the key buttons by a reflection pattern; a light emitting element for emitting light through the said side surface of the light conductive plate into the inside of the light conductive plate; and a reflecting plate formed in a side surface of the light conductive plate to which light emitted from the light emitting element is directed to reflect light into the inside of the light conductive plate.

Preferably, the reflecting plate is provided in the side surface of the light conductive plate opposite to the side surface through which light is emitted by the light emitting element.

More preferably, the reflecting plate is formed in all side surfaces except for a portion through which light is emitted by the light emitting element.

Preferably, the light emitting element is provided in one of a corner and the center of one edge of the light conductive plate. Preferably, the reflecting plate is one of a total reflection tape and a light reflective adhesive.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION OF THE INVENTION

FIGS. 3 through 7, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged key pad assembly.

In an exemplary embodiment, a light emitting element is a light emitting diode. However, in a keypad assembly according to the present invention, various light emitting elements as well as a light emitting diode can be used.

Figure 1:
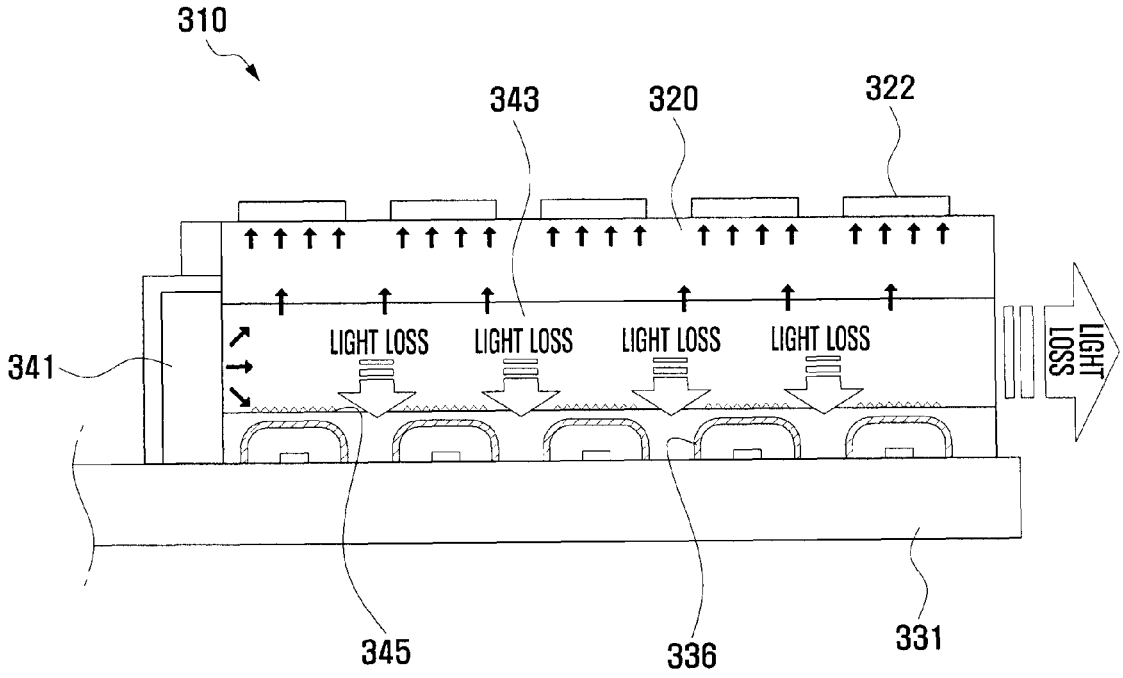
FIG. 1 is a cross-sectional view illustrating a structure of a conventional keypad assembly.
Figure 2:
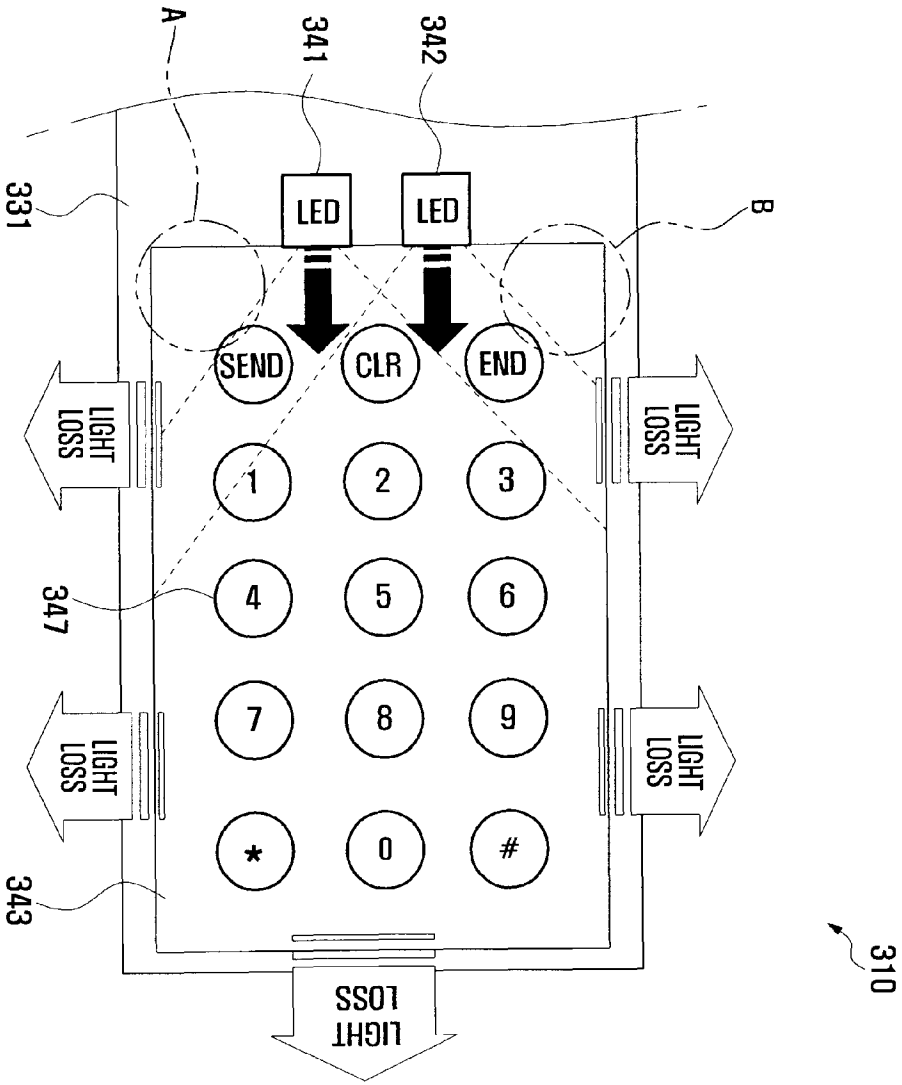
FIG. 2 is a diagram illustrating operation of the conventional keypad assembly of FIG. 1.
Figure 3:
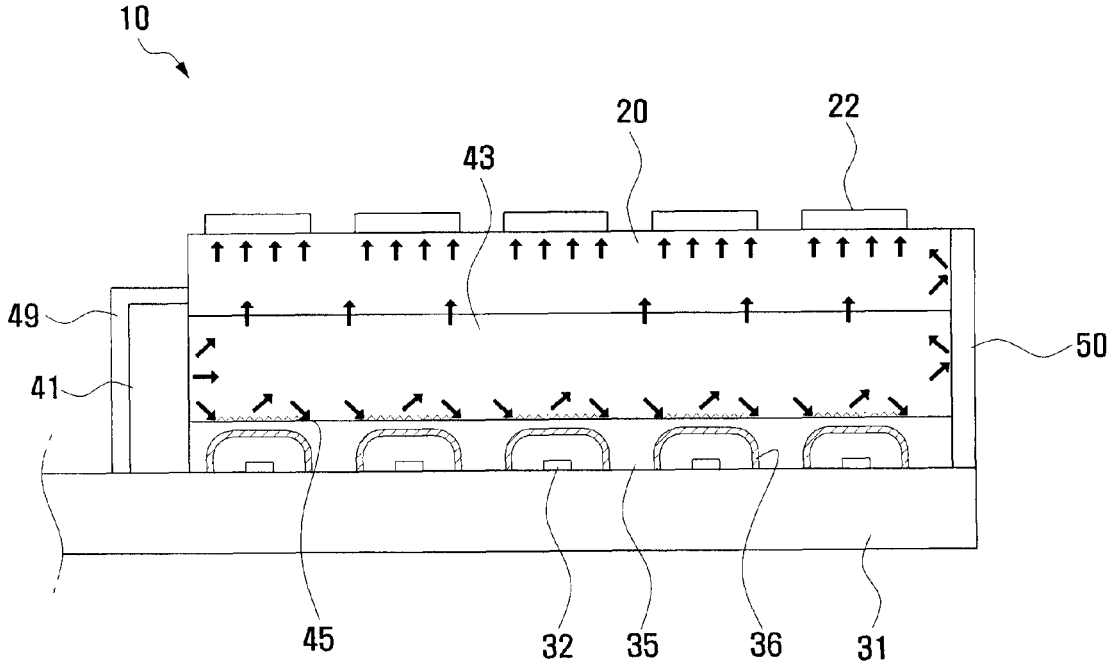
FIG. 3 is a cross-sectional view illustrating a structure of a keypad assembly according to a first exemplary embodiment of the present invention.
Figure 4:
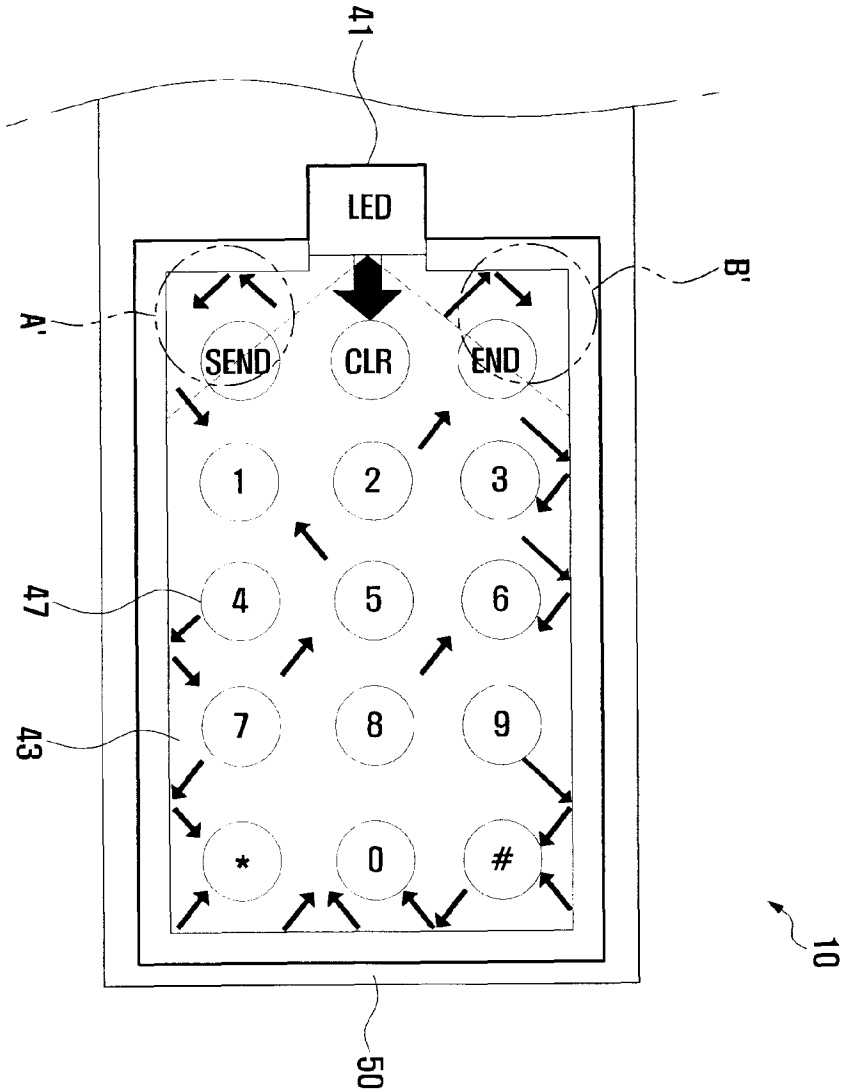
FIG. 4 is a diagram illustrating operation of the keypad assembly according to the first exemplary embodiment of the present invention.

FIG. 3 is a cross-sectional view illustrating a structure of a keypad assembly according to a first exemplary embodiment of the present invention. FIG. 4 is a diagram illustrating operation of the keypad assembly according to the first exemplary embodiment of the present invention.

Referring to FIGS. 3 and 4, a keypad assembly 10 according to the present exemplary embodiment includes a keypad 20, an electrically conductive dome 36, a PCB 31, a light emitting diode 41, a light conductive plate 43, and a reflecting plate 50. The keypad 20 includes a plurality of key buttons 22. Unlike the prior art, the keypad assembly 10 has one light emitting diode 41, and reflects light directed towards the outside of the keypad 20 to the inside of the light conductive plate 43 using the reflecting plate 50, thereby using light that would otherwise be lost to the outside.

The plurality of key buttons 22 are of a flat plate form. The key button 22 returns to its original position when a pressure applied thereto is released.

In an upper surface of the key button 22, a character, numeral, or picture is formed of a translucent or transparent engraved pattern. Each key button 22 can be formed in various shapes, such as a circular pillar and an oval pillar, and the entirety of key buttons 22 are arranged in a matrix form. The key button 22 is made of a material such as polycarbonate or acryl-based resin. The key button 22 is directly attached to an upper surface of the light conductive plate 43.

The light conductive plate 43 is provided in a lower part of the keypad 20. The light conductive plate 43 guides light emitted through one side surface to the other side surfaces. Light transmitted to the inside of the light conductive plate 43 is directed thereto by total reflection at the border between the light conductive plate 43 and the external environment.

The light conductive plate 43 is made of a material having low hardness, a high elastic strain, a high elastic restoring force, and an excellent light transmittance. For example, the light conductive plate 43 may be made of a material such as polyurethane and silicone.

The light conductive plate 43 is made of a light transmitting film of a quadrangular shape having flexibility. The light conductive plate 43 may have a different form according to an electronic device to which it is applied. Here, the light conductive plate 43 includes a light guide layer to which light is transmitted and an elastic layer formed in an upper surface and a lower surface of the light guide layer.

The light conductive plate 43 has a reflection pattern 45 formed in a lower part of the key button 22. The reflection pattern 45 reflects a part of light advancing to the inside of the light conductive plate 43 and transmits the part of light towards the key button 22. Light applied from the light emitting diode 41 illuminates each key button 22 by the reflection pattern 45 after being widely diffused in the light conductive plate 43. The reflection pattern 45 is formed by various methods, such as scratching and printing.

The light emitting diode 41 is mounted in the PCB 31 so as to be positioned in the side surface of the light conductive plate 43. The light emitting diode 41 receives power from the PCB 31 and supplies light required for illuminating the key buttons 22 to the side surface of the light conductive plate 43. Only one light emitting diode 41 is provided, and the light emitting diode 41 is provided adjacent to the center of one edge of the light conductive plate 43. Alternatively, the light emitting diode 41 may be provided at the corner. A light shielding member 49 prevents light generated in the light emitting diode 41 from escaping to the outside.

A dome sheet 35 and the PCB 31 are positioned in a lower part of the light conductive plate 43. A plurality of conductive connection terminals 32 are formed in an upper surface of the PCB 31. The dome sheet 35 has the electrically conductive domes 36 of hemispherical shape having a restoring force. The dome sheet 35 is attached to the upper surface of the PCB 31 so that each electrically conductive dome 36 covers the conductive connection terminal 32. The conductive connection terminal 32 and the electrically conductive dome 36 corresponding thereto are arranged at a lower side of the light conductive plate 43 below the key buttons 22. The conductive connection terminal 32 and the electrically conductive dome 36 corresponding thereto perform a switch function when the key button 22 is pressed. Although not described in detail, the dome sheet 35 has a structure in which the electrically conductive dome 36 is attached to an insulating adhesive sheet. The dome sheet 35 may have any form in which the conductive connection terminal 32 and the electrically conductive dome 36 are connected by pressing of the key button 22.

The reflecting plate 50 is provided at an edge of the light conductive plate 43. The reflecting plate 50 contacts with the side surface of the light conductive plate 43 into which light emitted from the light emitting diode 41 is discharged. The reflecting plate 50 reflects light directed towards the side surface of the light conductive plate 43, thereby returning the light to the inside of the light conductive plate 43. Light directed to the inside of the light conductive plate 43 by the reflecting plate 50 is not discharged to the outside and remains within the light conductive plate 43.

The reflecting plate 50 is formed in all or a part of the entire side surface of the light conductive plate 43 except a portion to which light is applied from the light emitting diode 41. When the reflecting plate 50 is formed in a part of the side surface, it is preferable that the reflecting plate 50 is formed in a portion in which light loss is greatest. For example, the reflecting plate 50 can be provided in a side surface of the light conductive plate 43 opposite to the light emitting diode 41. In the figure, the reflecting plate 50 is formed in the entire side surface of the light conductive plate 43 except a portion to which light is applied from the light emitting diode 41.

The reflecting plate 50 can use various members that can reflect light, such as a total reflection tape, a light reflective paint, and a light reflective adhesive. When the reflecting plate 50 is made of a total reflection tape, it is preferable that the reflecting plate 50 is easily provided in the light conductive plate 43 by forming an adhesion layer in a reflecting surface.

Light is emitted from the light emitting diode 41 through one side surface of the light conductive plate 43. Light emitted into the inside of the light conductive plate 43 is diffused to the entire light conductive plate 43 by total reflection. As light is transmitted to each key button 22 by the reflection pattern 45, the light illuminates a numeral, character, or picture formed with an engraved pattern in the key button.

Light directed towards the side surface except the portion to which light is applied from the light conductive plate 43 is reflected by the reflecting plate 50 and is again transmitted to the inside of the light conductive plate 43. In this way, light is not discharged to the outside and continues to circulate within the light conductive plate 43. Accordingly, because light is uniformly transmitted over the entire light conductive plate 43, all of the key buttons 22 can receive light with uniform brightness. Particularly, in the side surface in which the light emitting diode 41 is provided, both corners A' and B' located outside a light emitting angle of the light emitting diode 41 can receive light by a circulation operation of light reflected by the reflecting plate 50.

Figure 5A:
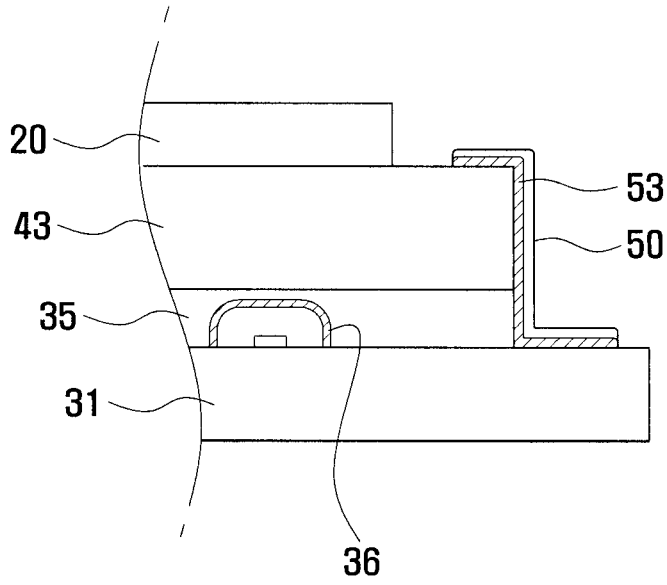
FIGS. 5A and 5B are partial cross-sectional views illustrating various coupling structures of a reflecting plate in the keypad assembly according to the present invention.
Figure 5B:
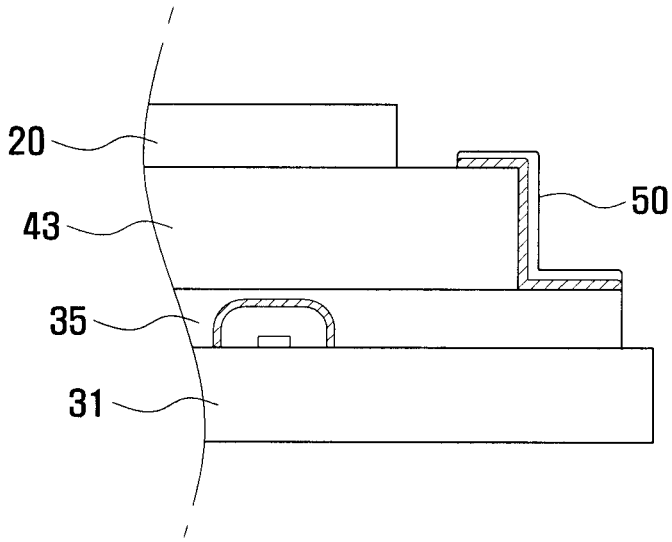

FIGS. 5A and 5B are partial cross-sectional views illustrating various coupling structures of a reflecting plate in the keypad assembly according to the present invention.

As shown in FIG. 5A, the reflecting plate 50 has a structure of a total reflection tape in which an adhesion layer 53 is formed on a reflecting surface. The dome sheet 35 is formed to be the same size as the light conductive plate 43 at their attached surface, and the reflecting plate 50 can be coupled after the light conductive plate 43 is attached to the dome sheet 35. Further, as shown in FIG. 5B, the dome sheet 35 is formed to be of greater size than the light conductive plate 43 at their attached surface, and the reflecting plate 50 can be coupled after the dome sheet 35 and the light conductive plate 43 are attached. In this case, the reflecting plate 50 may be of a form in which a total reflection paint or a total reflection adhesive is applied along an edge of the reflecting plate 50.

The reflecting plate 50 may be formed enclosing an upper surface, side surfaces, and a lower surface of an edge of the light conductive plate 43, or may be attached in a form that encloses the dome sheet 35 together with the light conductive plate 43. By such a coupling structure of the reflecting plate 50, the reflecting plate 50 can be easily formed.

In the above-described exemplary embodiment, the keypad assembly according to the present invention uses light directed towards a side surface of the light conductive plate that would otherwise be lost to the outside by reflecting with the reflecting plate. Light is circulated and uniformly distributed within the entire light conductive plate. Because light loss is minimized and light utilization efficiency is improved, a light emitting effect for which conventionally two or three light sources are provided is obtained in the present invention using one light emitting element.

Figure 6:
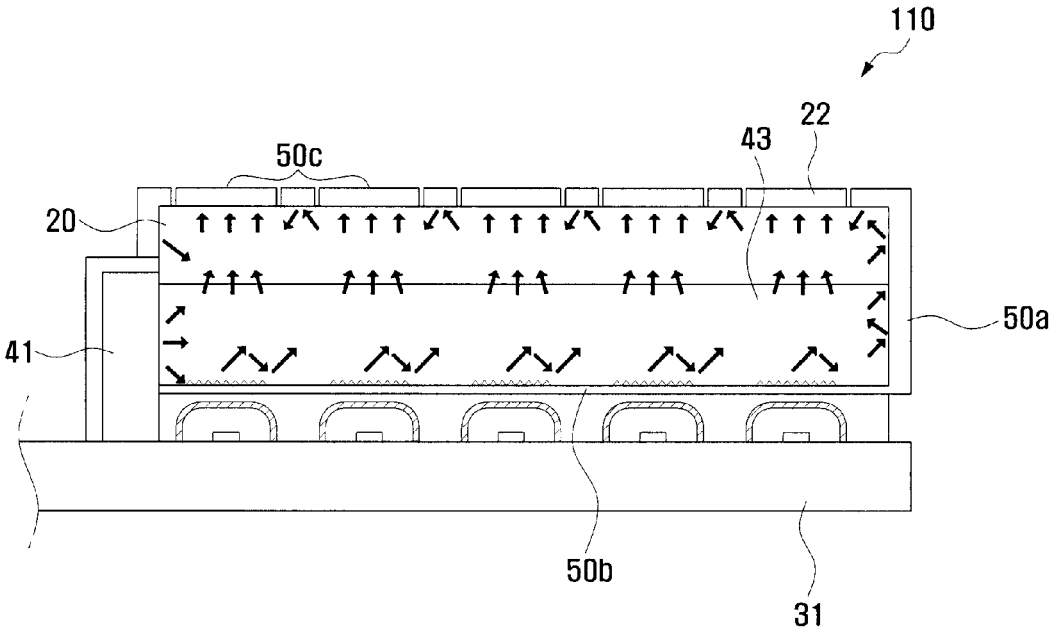
FIG. 6 is a cross-sectional view illustrating a structure of a keypad assembly according to a second exemplary embodiment of the present invention.

FIG. 6 is a cross-sectional view illustrating a structure of a keypad assembly according to a second exemplary embodiment of the present invention.

In a keypad assembly 110 of FIG. 6, a reflecting plate 50*a* is formed at a side surface of the light conductive plate 43 except for a portion to which light is applied from the light emitting diode 41, a reflecting plate 50*b* is formed at a lower surface of the light conductive plate 43, and a reflecting plate 50*c* is formed at an upper surface of the keypad 20 except for the key button 22. The reflecting plates 50*a*, 50*b*, and 50*c* are attached to enclose the side surface of the light conductive plate 43 and the side surface of the keypad 20.

Unlike in the first exemplary embodiment, in the second exemplary embodiment, the keypad assembly 110 reflects light that would otherwise be discharged through the upper surface and lower surface as well as through the side surface of the light conductive plate 43. Light directed towards the keypad 20 except the key button 22 is reflected by the reflecting plate 50*c* and transmitted towards the key button 22. The reflecting plate 50*b* formed at the lower surface of the light conductive plate 43 reflects light directed towards the lower surface of the light conductive plate 43, thereby transmitting the light to the inside of the light conductive plate 43.

Figure 7:
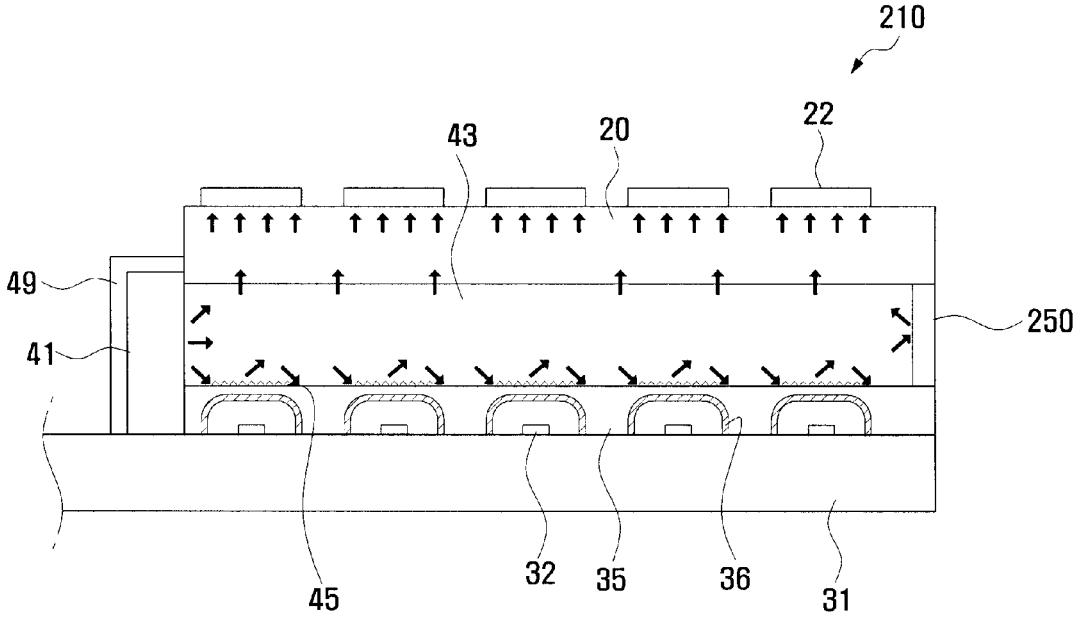
FIG. 7 is a cross-sectional view illustrating a structure of a keypad assembly according to a third exemplary embodiment of the present invention.

FIG. 7 is a cross-sectional view illustrating a structure of a keypad assembly according to a third exemplary embodiment of the present invention.

A keypad assembly 210 of FIG. 7 has a structure in which a reflecting plate 250 is formed integrally with the light conductive plate 43 in a side surface of the light conductive plate 43 except a portion to which light is applied from the light emitting diode 41. The reflecting plate 250 is made of a medium optically thinner (i.e., a material having a smaller refractive index) than the light conductive plate 43 so as to cause total reflection using Snell's law. As the reflecting plate 250 is made of a material having a refractive index in which light applied from the light conductive plate 43 can be totally reflected, the reflecting plate 250 reflects all of the applied light towards the light conductive plate 43. The reflecting plate 250 can be formed in a manufacturing process of the light conductive plate 43.

The keypad assembly according to the present invention is not limited to the above-described exemplary embodiments.

As described above, according to the present invention, the keypad assembly has a reflecting plate in a portion in which light loss is generated. By reflecting light that would otherwise be lost to the inside of the light conductive plate using the reflecting plate, the reflected light is used as emitted light. Using a single light emitting element, a light emitting effect can be obtained that could otherwise only be obtained using a plurality of light emitting elements. As a light utilization efficiency improves, the quantity of light emitting elements can be reduced. Accordingly, cost can be reduced. Further, power consumption can be reduced and a using time period of a battery can be extended.

Further, by transmitting again light that would otherwise be lost through a side surface of the light conductive plate to the inside of the light conductive plate, light can be uniformly transmitted in a wider range. Accordingly, light can be transmitted to a corner adjacent to the light emitting element.

Although the present disclosure has been described with exemplary embodiments, various changes and modifications may be suggested to one skilled in the art. It is intended that the present disclosure encompass such changes and modifications as fall within the scope of the appended claims.

What is claimed is:

1. A keypad assembly having a key pad with key buttons, comprising:

a light conductive plate for advancing light emitted through a first side surface thereof into the inside thereof and for radiating light to the key buttons by a reflection pattern;

a light emitting element for emitting light through the said first side surface of the light conductive plate into the inside of the light conductive plate; and a reflecting plate formed in a second side surface of the light conductive plate to which light emitted from the light emitting element is directed to reflect light into the inside of the light conductive plate, wherein the reflecting plate is a total reflection tape.

2. The keypad assembly of claim 1, wherein the reflecting plate is provided in the second side surface of the light conductive plate opposite to the first side surface through which light is emitted by the light emitting element.

3. The keypad assembly of claim 1, wherein the reflecting plate is formed in whole side surface except for a portion through which light is emitted by the light emitting element.

4. The keypad assembly of claim 1, wherein the reflecting plate is formed in an upper surface of the light conductive plate except for the key button to which light is radiated.

5. The keypad assembly of claim 1, wherein the quantity of the light emitting element is one.

6. The keypad assembly of claim 5, wherein the light emitting element is provided in one of a corner and the center of one edge of the light conductive plate.

7. The keypad assembly of claim 1, wherein the reflecting plate is formed by adhering an adhesion layer to a reflection surface.

8. The keypad assembly of claim 1, wherein the reflecting plate is a light reflective adhesive.

9. The keypad assembly of claim 1, wherein the reflecting plate is attached to enclose the side surfaces of the light conductive plate and of the keypad.

10. A keypad assembly having a key pad with key buttons, comprising:

a light conductive plate configured to advance light emitted through a first side surface thereof into the inside thereof and radiate the emitted light to the key buttons by a reflection pattern; and a reflecting plate formed in a second side surface of the light conductive plate, the reflecting plate configured to reflect the emitted light into the inside of the light conductive plate, wherein the reflecting plate is a total reflection tape.

11. The keypad assembly of claim 10, wherein the reflecting plate is provided in the second side surface of the light conductive plate opposite to the first side surface through which light is emitted.

12. The keypad assembly of claim 10, wherein the reflecting plate is formed in the entire side surface of the light conductive plate except for a portion through which light is emitted.

13. The keypad assembly of claim 10, wherein the reflecting plate is formed in an upper surface of the light conductive plate except for the key button to which light is radiated.

14. The keypad assembly of claim 10, wherein the reflecting plate is a light reflective adhesive.

15. A keypad assembly comprising:

a key pad with key buttons;

a light conductive plate configured to advance light emitted through a first side surface thereof into the inside thereof and radiate the emitted light to the key buttons by a reflection pattern; and a reflecting plate formed in a second side surface of the light conductive plate, the reflecting plate configured to reflect the emitted light into the inside of the light conductive plate, wherein the reflecting plate is a total reflection tape.

16. The keypad assembly of claim 15, wherein the reflecting plate is provided in the second side surface of the light conductive plate opposite to the first side surface through which light is emitted by the light emitting element.

17. The keypad assembly of claim 15, wherein the reflecting plate is formed in whole side surface except for a portion through which light is emitted by the light emitting element.

18. The keypad assembly of claim 15, wherein the reflecting plate is formed in an upper surface of the light conductive plate except for the key button to which light is radiated.

19. The keypad assembly of claim 15, wherein the reflecting plate is formed by adhering an adhesion layer to a reflection surface.

20. The keypad assembly of claim 15, wherein the reflecting plate is attached to enclose the side surfaces of the light conductive plate and of the keypad.

* * * * *